US008757832B2

(12) United States Patent
Kim

(10) Patent No.: US 8,757,832 B2
(45) Date of Patent: Jun. 24, 2014

(54) LED LIGHTING LAMP

(75) Inventor: Ha Chul Kim, Seoul (KR)

(73) Assignee: Lumirich Co., Ltd., Incheon (KR)

( * ) Notice: Subject to any disclaimer, the term of this patent is extended or adjusted under 35 U.S.C. 154(b) by 219 days.

(21) Appl. No.: 13/379,647

(22) PCT Filed: Mar. 23, 2011

(86) PCT No.: PCT/KR2011/001980

§ 371 (c)(1),
(2), (4) Date: Dec. 20, 2011

(87) PCT Pub. No.: WO2011/122781

PCT Pub. Date: Oct. 6, 2011

(65) Prior Publication Data

US 2012/0099302 A1 Apr. 26, 2012

(30) Foreign Application Priority Data

Apr. 2, 2010 (KR) ..... 10-2010-0030174

(51) Int. Cl.
*F21V 21/00* (2006.01)
*F21V 23/00* (2006.01)

(52) U.S. Cl.
USPC ..... 362/217.01; 362/249.02; 362/260; 362/223

(58) Field of Classification Search
USPC ..... 362/217.01, 217.02, 218, 223, 260, 362/294, 249.02; 439/56, 619
See application file for complete search history.

(56) References Cited

U.S. PATENT DOCUMENTS

| | | | | |
|---|---|---|---|---|
| 7,737,463 | B2 * | 6/2010 | Lee et al. | 257/99 |
| 7,988,492 | B2 * | 8/2011 | Pei et al. | 439/619 |
| 8,232,724 | B2 * | 7/2012 | Mostoller et al. | 313/512 |
| 8,235,539 | B2 * | 8/2012 | Thomas et al. | 362/92 |
| 8,360,599 | B2 * | 1/2013 | Ivey et al. | 362/218 |
| 8,382,321 | B2 * | 2/2013 | Lee et al. | 362/249.02 |
| 2006/0126325 | A1 * | 6/2006 | Lefebvre et al. | 362/217 |

FOREIGN PATENT DOCUMENTS

| | | |
|---|---|---|
| JP | 2000-11738 | 1/2000 |
| JP | 2002-140901 | 5/2002 |
| JP | 2002-140901 A | 5/2002 |
| JP | 2003-263917 | 9/2003 |
| JP | 3142652 U | 6/2008 |
| JP | 2008-243498 | 10/2008 |
| JP | 3148527 | 1/2009 |
| JP | 3148721 | 2/2009 |
| JP | 2010-3683 | 1/2010 |
| JP | 2010-40221 | 2/2010 |
| KR | 20-0444408 Y1 | 5/2009 |
| KR | 10-0918995 B1 | 9/2009 |
| KR | 10-0938932 | 1/2010 |
| KR | 10-0949699 B1 | 3/2010 |

* cited by examiner

*Primary Examiner* — Peggy A. Neils
(74) *Attorney, Agent, or Firm* — Rabin & Berdo, P.C.

(57) ABSTRACT

A light emitting diode lighting lamp includes: an LED module having at least one LED PCB and a plurality of LED devices which are disposed on the LED PCB; a cover enclosing the LED module; and a pair of bases which are respectively connected to both ends of the cover. The respective base includes: a cap which coupled to an end of the cover; a pin portion for applying electricity to the LED module; a fixing portion surrounding a lower end of the pin portion to fix the pin portion; and a guard which is formed to be higher than an end of the pin portion and encloses the pin portion along a circumference direction.

14 Claims, 4 Drawing Sheets

LED LIGHTING LAMP

CROSS-REFERENCE TO RELATED APPLICATION

This application claims priority to and the benefit of Korean Patent Application No. 10-2010-0030174 filed in the Korean Intellectual Property Office on Apr. 2, 2010, the entire contents of which are incorporated herein by reference.

FIELD OF THE INVENTION

The present invention relates to a light emitting diode (LED) lighting lamp.

BACKGROUND ART

In case of a conventional fluorescent lamp device, a fluorescent lamp is fitted into a socket having G13 Base of a lamp mount. A pin portion of G13 Base may be deformed by a long time use, and this may cause a safety problem that the fluorescent lamp may be separated and dropped.

An LED fluorescent lamp may also use G13 Base and thus it is used to be connected to a conventional lamp mount, so if a user may connect the LED fluorescent lamp to a conventional ballast stabilizer, electric shock or fire may occur and this may raise credibility problem of the LED fluorescent lamp.

Technical Problem

The present invention has been made in an effort to provide a light emitting diode lighting lamp which can prevent product damages and fire risk.

In addition, the present invention has been made in an effort to provide a light emitting diode lighting lamp which breakdown or safety accident due to drop and angle of light emission can be widened.

Technical Solution

A light emitting diode lighting lamp according to an exemplary embodiment of the present invention includes: a light emitting diode (LED) module having at least one light emitting diode (LED) printed circuit board (PCB) and a plurality of light emitting diode devices which are disposed on the LED PCB; a cover enclosing the LED module; and a pair of bases which are respectively connected to both ends of the cover. The respective base includes: a cap which coupled to an end of the cover; a pin portion for applying electricity to the LED module; a fixing portion surrounding a lower end of the pin portion to fix the pin portion; and a guard which is formed to be higher than an end of the pin portion and encloses the pin portion along a circumference direction.

The pin portion may include two pins which have respectively a rod shape and are arranged to be parallel with one another, and the two pins may be respectively extended in a vertical direction at the outside of the cap and are extended to penetrate the cap to reach an inside of the cover.

Each of the pair of the bases may be a R17D base standard.

The LED module may include a converter which converts an alternating current into a direct current and supplies the converted direct current to the LED PCB.

The LED PCB may have a rod shape, and the plurality of the LED devices may be arranged on an upper surface of the LED PCB in a line along a longitudinal direction of the rod shape.

The cover may include a light diffusion cover which has a hollow cylindrical shape to enclose the LED PCB to diffuse light emitted from the LED devices.

The light diffusion cover may include inner grooves which are formed on both sides of an inner surface thereof along a longitudinal direction to be connected with the LED PCB.

The light diffusion cover may be made of diffusing type polycarbonate or diffusing type glass.

The cover may include: a light diffusion cover which encloses the LED devices to diffuse light emitted from the LED devices; and a heat radiation plate which encloses a lower surface of the LED PCB to dissipate heat of the LED PCB.

The light diffusion cover and the heat radiation plate may be connected to one another to form a hollow cylindrical shape.

The heat radiation plate may include: outer grooves which are formed on both sides of an outer surface thereof along a longitudinal direction of the hollow cylindrical shape to be connected to the light diffusion cover; and inner grooves which are formed on both sides of an inner surface thereof along a longitudinal direction of the hollow cylindrical shape to be connected to the LED PCB.

The heat radiation plate may include: outer grooves which are formed on both sides of an outer surface thereof along a longitudinal direction of the hollow cylindrical shape to be connected to the light diffusion cover; and a protrusion which is formed along a longitudinal direction of the hollow cylindrical shape and to which the LED PCB is mounted.

An upper surface of the protrusion may be divided into two portions and a sectional view thereof is a shape of a caret symbol ˆ, and wherein the at least one LED devices may be provided two and the LED devices are respectively disposed on the divided portions of the upper surface of the protrusion.

The light diffusion cover may be made of diffusing type polycarbonate or diffusing type glass.

The heat radiation plate may be formed by a double injection molding with ABS (Acrvlonitrile/Butadien/Styrene), PPS (Poly Phenylene Sulfide), and PPA (Poly Phthal Amide).

The LED module may include a converter which converts an alternating current into a direct current and supplies the converted direct current to the LED PCB.

Advantageous Effects

According to the present invention, by using a base of R17D Base standard, the pin portion which is an electrode is not exposed to the outside so that electric shock or fire risk can be prevented so as to enhance stability, and damage of a product or fire risk which may occur when an LED lighting lamp of G13 Base is being connected to a ballast stabilizer for a conventional fluorescent lamp of G13 Base can be prevented.

Furthermore, since a circular light diffusion cover is used, weight of the device can be reduced and breakdown or safety accident due to drop can be prevented.

Furthermore, since the plurality of the light emitting diode devices are arranged in various angles, angle of light emission can be widened.

DETAILED DESCRIPTIONS OF THE EMBODIMENTS

Embodiments of the present invention will be explained with reference to the accompanied drawings hereinafter.

Figure 1:
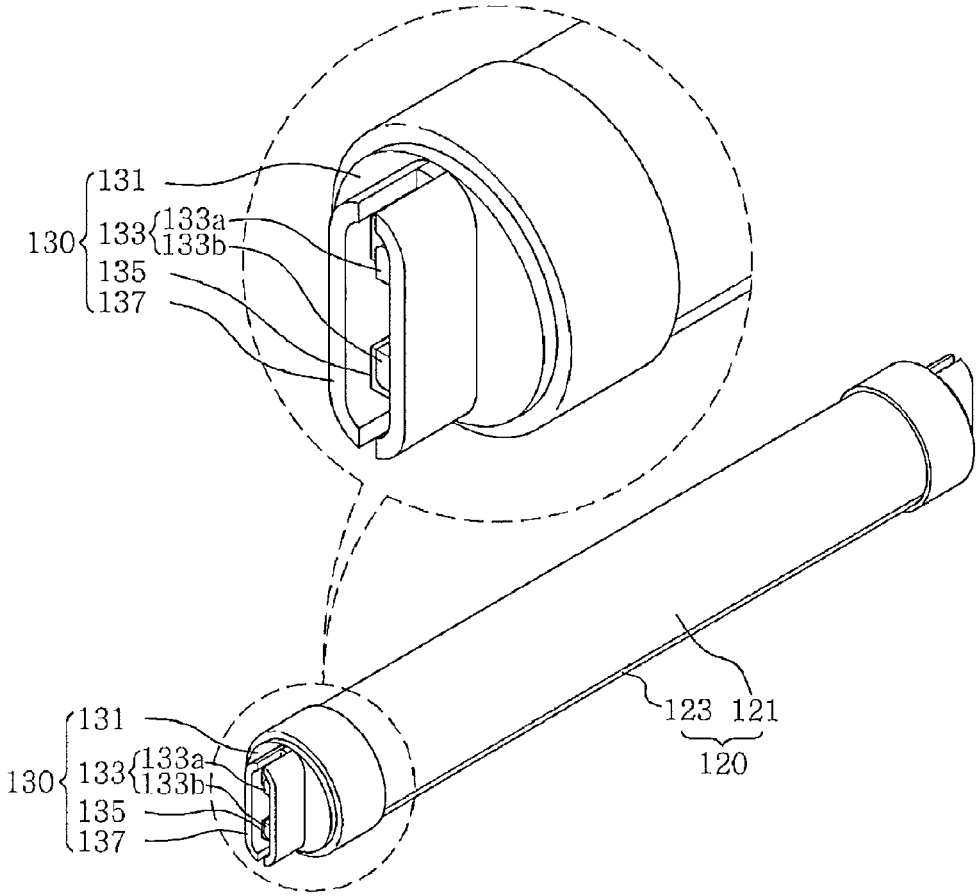
FIG. 1 is a perspective view of a light emitting diode lighting lamp according to an embodiment of the present invention.
Figure 2:
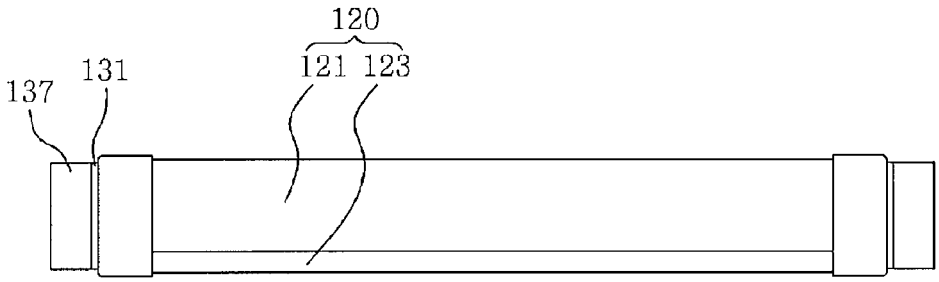
FIG. 2 is a front view of a light emitting diode lighting lamp according to an embodiment of the present invention.

FIG. 1 is a perspective view of a light emitting diode lighting lamp according to an embodiment of the present invention, and FIG. 2 is a front view of a light emitting diode lighting lamp according to an embodiment of the present invention.

Figure 3:
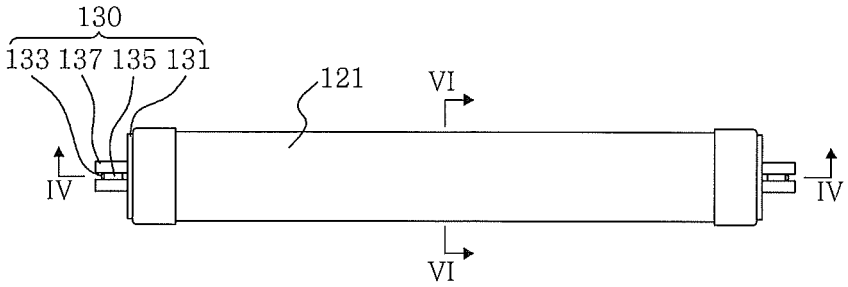
FIG. 3 is a top view of a light emitting diode lighting lamp according to an embodiment of the present invention.
Figure 4:
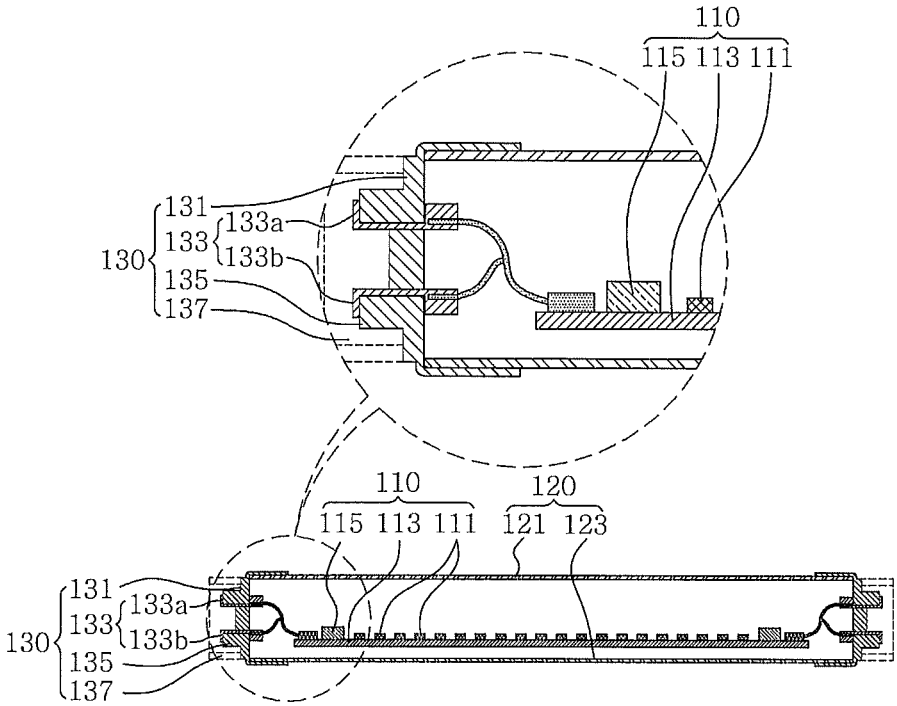
FIG. 4 is a cross sectional view taken along a line IV-IV in FIG. 3.
Figure 5:
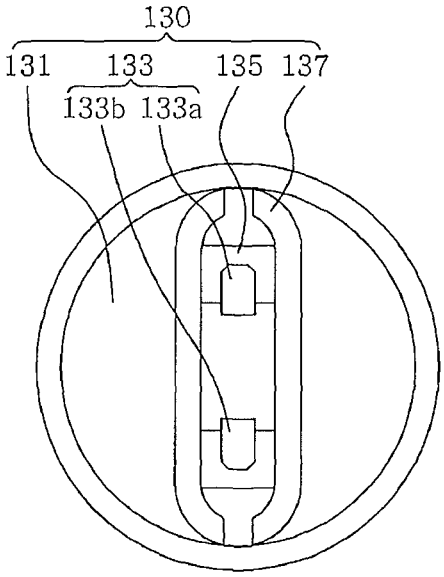
FIG. 5 is a side view of a light emitting diode lighting lamp according to another embodiment of the present invention.
Figure 6:
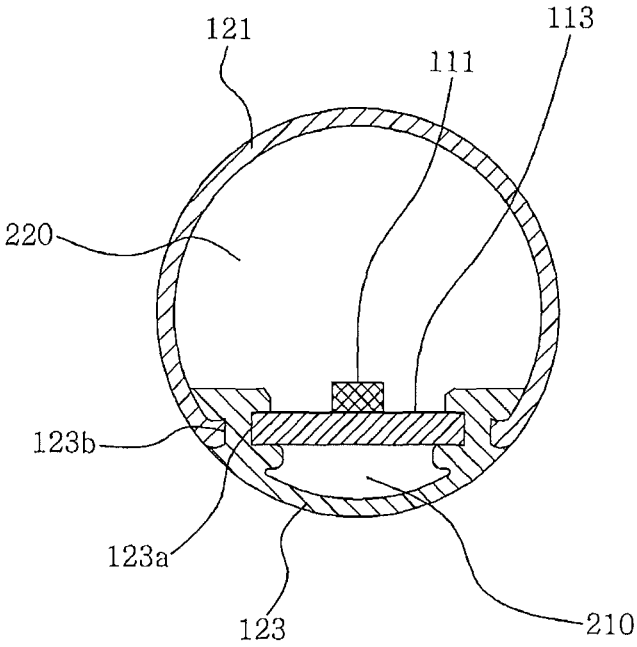
FIG. 6 is a cross sectional view taken along a line VI-VI in FIG. 3.

FIG. 3 is a top view of a light emitting diode lighting lamp according to an embodiment of the present invention, FIG. 4 is a cross sectional view taken along a line IV-IV in FIG. 3, FIG. 5 is a side view of a light emitting diode lighting lamp according to another embodiment of the present invention, and FIG. 6 is a cross sectional view taken along a line VI-VI in FIG. 3.

Referring to FIG. 1 to FIG. 6, a light emitting diode (LED) lamp according to an embodiment of the present invention includes a light emitting diode (LED) module 110 which includes at least one LED printed circuit board (PCB) 113 and a plurality of light emitting diode devices 111, and a cover 120 enclosing the LED module 110.

The LED lighting lamp may include a pair of bases 130 which are respectively coupled to both ends of the cover 120. The respective base 130 includes a cap 131 coupled to an end of the cover 121, a pin portion 133 for applying electricity to the LED module 110, a fixing portion 135 surrounding a lower end of the pin 133 to fix the pin portion 133, and a guard portion 137 which is formed to be higher than an end of the pin portion 133 and encloses the pin portion 133 along a circumference direction.

The LED PCB 113 plays a role of fixing the plurality of the LED devices 111 which emit light and electrically connecting the same. Further, the fixing portion 135 which fixes the pin portion 133 may be made of plastic injection molding.

Referring to FIG. 4, the pin portion 133 includes two pins 133*a* and 133*b* which have respectively a rod shape and are arranged to be parallel with one another, and the two pins 133*a* and 133*b* may be extended in a vertical direction at the outside of the cap 131 so as to be connectable with an external electric power socket and at the same time may be respectively extended to penetrate the cap 131 to reach the inside of the cover 120 so as to be connected to the LED module 110. That is, electric power is supplied to the LED module 110 from the external electric power socket via the pins 133*a* and 133*b*.

Referring to FIG. 3 and FIG. 4, the guard portion 137 may be formed to be longer (higher) than the pin portion 133, i.e., be protruded from the end of the pin portion 137, so as to make the pin portion 133 not be easily touched by a hand of a user, etc.

The pair of the bases 130 may have a R17D base standard. That is, the shape of the base 130 may be a shape in accordance with a R17D base standard.

According to an embodiment of the present invention, by using the base 130 of R17D Base standard type, the pin portion 133 which is an electrode is not exposed so that user's electric shock or fire risk can be prevented so as to enhance safety, and damage of a product or fire risk which may occur when an LED lighting lamp of G13 Base is being connected to a ballast stabilizer for a conventional fluorescent lamp of G13 Base can be prevented.

Referring to FIG. 4, the LED module 110 may further include a converter 115 which converts an alternating current into a direct current and supplies the converted direct current to the LED PCB 113. As shown in FIG. 4, the converter 115 may be disposed on both ends of an upper surface of the LED PCB 113, and converts an alternating current of 110 to 220V into a direct current.

Referring to FIG. 4 and FIG. 6, the LED lighting lamp include the LED module 110 having the at least one LED PCB 113 and a plurality of the LED device 111 disposed on an upper surface of the LED PCB 113, and the cover 120 enclosing the LED module 110, and the LED PCB 113 may have a rod shape and the plurality of the LED devices 111 may be arranged in a line along a length direction of the LED device 111 on an upper surface of the LED PCB 113.

In addition, referring to FIG. 4 and FIG. 6, the cover 120 may include a light diffusion cover 121 which encloses the LED device 111 to diffuse light emitted from the LED device 111 and a heat radiation plate 123 which encloses a lower surface of the LED PCB 113 to dissipate heat of the LED PCB 113.

Referring to FIG. 2 and FIG. 6, a sectional shape of the light diffusion cover 121 is a half-circle shape and the light diffusion cover 121 has a tube shape which is elongated in a later direction shown in FIG. 2 and its lower side is open to enclose the plurality of the LED devices 111. In addition, a sectional shape of the heat radiation plate 123 is a half-circle shape and the heat radiation plate 123 has a tube shape which is elongated in a lateral direction shown in FIG. 2 and its upper side is open to enclose a lower surface of the LED PCB 113.

Further, as shown in FIG. 6, the light diffusion cover 121 and the heat radiation plate 123 are connected to one another to form a circular hollow tube.

The LED PCB 113 is disposed between the light diffusion cover 121 and the heat radiation plate 123 and is connected to the light diffusion cover 121 or the heat radiation plate 123. Referring to FIG. 6, the heat radiation plate 123 may include outer grooves 123*b* which are formed respectively on both outer surfaces thereof along a longitudinal direction and to which the light diffusion cover 121 is connected, and inner grooves 123*a* which are formed respectively on both inner surfaces thereof along a longitudinal direction and to which the LED PCB 113 is connected.

That is, lower ends of the light diffusion cover 121 are respectively fitted into the outer grooves 123*b* of the heat radiation plate 123 so that the light diffusion cover 121 and the heat radiation plate 123 can be coupled.

Further, the LED PCB 113 may be fitted into the inner grooves 123*a* of the heat radiation plate 123. As an example, the LED PCB 113 may be formed as one, and both end portions of the LED PCB 113 are respectively fitted into the inner grooves 123*a* of the heat radiation plate 123. As another example, at one of the LED PCB 113 may be formed as two, end portions of the two LED PCBs 113 are fitted into the inner grooves 123*a* of the heat radiation plate 123.

That is, the above-stated connections are examples, and the LED PCB 113 can be disposed within a space formed by the light diffusion cover 121 and the heat radiation plate 123 in various ways. The inner grooves 123*a* of the heat radiation plate 123 may also be varied in accordance with the structure of the LED PCB 113. The way of connections of the light diffusion cover 121, the heat radiation plate 123 and the LED PCB 113 may be preferably determined in consideration of light diffusion efficiency and reduction of dazzle by the light diffusion cover 121 and heat radiation efficiency by the heat radiation plate 123.

Furthermore, in a conventional lamp device using a light emitting diode, a light emitting diode module is attached to an inner upper surface of a cover frame and a light diffusion plate which covers very wide area is attached to a lower side of the cover frame, so the expensive light diffusion plate is used much to raise manufacturing cost and the light diffusion plate is far from the LED device so that light efficiency is deteriorated, but in the present invention a distance between the light diffusion cover 121 and the LED device 111 is minimized and the light diffusion cover 121 is minimally used, so light efficiency can be enhanced and at the same time eye dazzle can be reduced, and manufacturing cost and weight can be reduced.

An air layer 210 may be formed between the heat radiation plate 123 and a lower surface of the LED PCB 113. In addition, an air layer 220 may also be formed between the light diffusion cover 121 and an upper surface of the LED PCB 113. The air layers 210 and 220 can prevent the LED PCB 113 from being bent by heat.

It is preferable that the light diffusion cover 121 is made of material which can diffuse uniformly light emitted from the LED device 111, and accordingly the light diffusion cover 121 is made of diffusing type polycarbonate or diffusing type glass.

The heat radiation plate 123 may be made of aluminum. Aluminum can effectively radiate heat and at the same time is light-weight. As such, weight reduction can prevent parts from being deformed, so safety accident by drop of parts caused by deformation can be prevented.

The heat radiation plate 123 may be formed by a double injection molding using ABS, PPS, and PPA. That is, the heat radiation plate 123 can increase a bending intensity of the light diffusion cover 121 by being coupled with the light diffusion cover 121, and the heat radiation plate 123 may be formed by a double injection molding using material such as ABS(Acrvlonitrile/Butadien/Styrene), PPS(Poly Phenylene Sulfide), and PPA(Poly Phthal Amide), which are different material from that of the light diffusion cover 121. Here, a double injection molding means an injection molding which is performed using different plural materials. A thermal-resisting property can be enhanced by a double injection molding. The heat radiation plate 123 which is formed in this way can effectively radiate heat.

Figure 7:
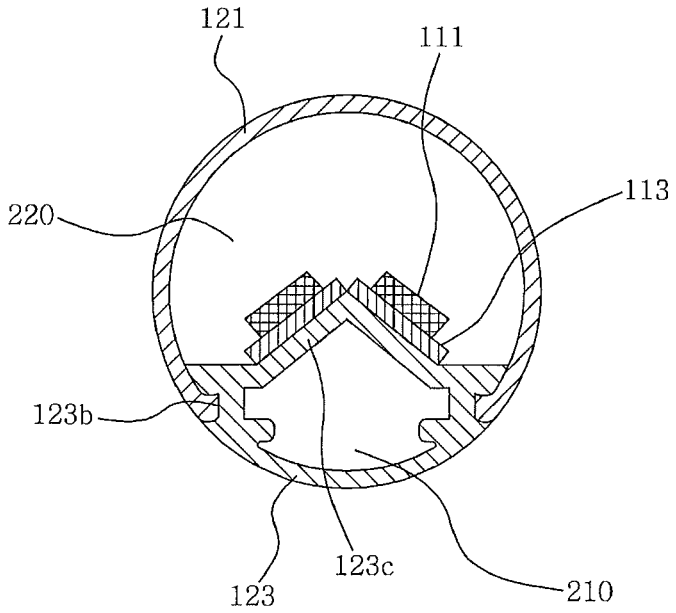
FIG. 7 is a cross sectional view of a light emitting diode lighting lamp according to another embodiment of the present invention.

FIG. 7 is a cross sectional view of a light emitting diode lighting lamp according to another embodiment of the present invention.

Referring to FIG. 7, in an LED lighting lamp according to another embodiment of the present invention, the heat radiation plate 123 may include outer grooves 123*b* which are formed respectively on both outer surfaces thereof along a longitudinal direction and to which the light diffusion cover 121 is connected, and a protrusion 123*c* which is formed along a longitudinal direction of the hollow cylindrical shape and to which the LED PCB 113 is mounted.

In more detail, as shown in FIG. 7, an upper surface of the protrusions 123*c* is divided into two portions so as to form a shape of a caret symbol A and the LED PCBs 113 are formed as two and the two LED PCBs 113 are respectively disposed on the divided upper surface of the protrusion 123*c*.

Further, the protrusion 123*c* may be divided into three or more portions, and three or more LED PCBs 113 are disposed on an upper surface thereof.

Since the plurality of the light emitting diode devices are arranged in various angles, angle of light emission can be widened.

An air layer 210 may be formed between the heat radiation plate 123 and a lower surface of the protrusion 123*c*. In addition, an air layer 220 may also be formed between the light diffusion cover 121 and upper surfaces of the LED PCBs 113. The air layers 210 and 220 may prevent the LED PCB 113 being bent by heat.

It is preferable that the light diffusion cover 121 is made of material which can diffuse uniformly light emitted from the LED device 111, and accordingly the light diffusion cover 121 is made of diffusing type polycarbonate or diffusing type glass.

The heat radiation plate 123 may be formed by a double injection molding using ABS, PPS, and PPA. That is, the heat radiation plate 123 can increase a bending intensity of the light diffusion cover 121 by being coupled with the light diffusion cover 121, and the heat radiation plate 123 may be formed by a double injection molding using material such as ABS(Acrvlonitrile/Butadien/Styrene), PPS(Poly Phenylene Sulfide), and PPA(Poly Phthal Amide), which are different material from that of the light diffusion cover 121. Here, a double injection molding means an injection molding which is performed using different plural materials. A thermal-resisting property can be enhanced by a double injection molding. The heat radiation plate 123 which is formed in this way can effectively radiate heat.

Figure 8:
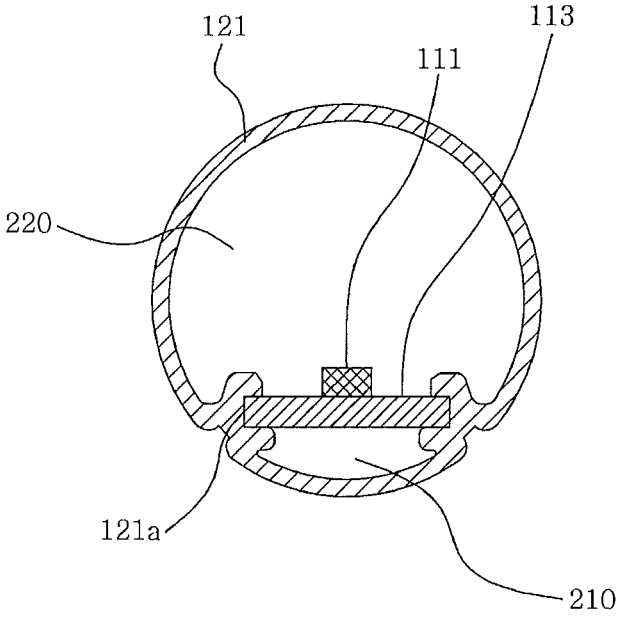
FIG. 8 is a cross sectional view of a light emitting diode lighting lamp according to yet another embodiment of the present invention.

FIG. 8 is a cross sectional view of a light emitting diode lighting lamp according to yet another embodiment of the present invention.

As shown in FIG. 8, in an LED lighting lamp according to yet another embodiment of the present invention, the cover 120 may include the light diffusion cover 121 which has a hollow cylindrical shape and encloses the LED PCB 113 to diffuse light emitted from the LED device 111.

The LED PCB 113 on which the plurality of the LED devices 11 are mounted can be enclosed by the cylindrical shape member which is obtained by the combination of the light diffusion cover 121 and the heat radiation plate 123, and in case that the light diffusion cover 121 has a cylindrical shape, the heat radiation plate 123 can be omitted. That is, The LED PCB 113 on which the plurality of the LED devices 11 are mounted can be enclosed only by the light diffusion cover 121. Exemplarily, the LED PCB 113 can be inserted into a cylindrical glass tube or a cylindrical diffusion tube.

The light diffusion cover 121 may include inner grooves 121*a* which are formed on both sides of an inner surface thereof, and the LED PCB 113 can be coupled to the inner grooves 121*a*.

As such, by using a circular diffusion cover, weight of the device can be reduced so that breakdown or safety accident due to drop of the diffusion cover can be prevented.

It is preferable that the light diffusion cover 121 is made of material which can diffuse uniformly light emitted from the LED device 111, and accordingly the light diffusion cover 121 is made of diffusing type polycarbonate or diffusing type glass.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A light emitting diode lighting lamp comprising:

a light emitting diode (LED) module having at least one light emitting diode (LED) printed circuit board (PCB) and a plurality of light emitting diode devices which are disposed on the LED PCB;

a cover enclosing the LED module; and a pair of bases which are respectively connected to both ends of the cover, wherein the respective base comprises:

a cap which coupled to an end of the cover;

a pin portion for applying electricity to the LED module, the pin portion comprising two pins which have respectively a rod shape and are arranged to be parallel with one another, the two pins being respectively extended in a vertical direction at the outside of the cap and are extended to penetrate the cap to reach an inside of the cover;

a fixing portion surrounding a lower end of the pin portion to fix the pin portion; and a guard which is formed to be higher than an end of the pin portion and encloses the pin portion along a circumference direction.

2. The light emitting diode lighting lamp of claim 1, wherein the LED module comprises a converter which converts an alternating current into a direct current and supplies the converted direct current to the LED PCB.

3. The light emitting diode lighting lamp of claim 1, wherein the LED PCB has a rod shape, and the plurality of the LED devices are arranged on an upper surface of the LED PCB in a line along a longitudinal direction of the rod shape.

4. The light emitting diode lighting lamp of claim 3, wherein the cover comprises a light diffusion cover which has a hollow cylindrical shape to enclose the LED PCB to diffuse light emitted from the LED devices.

5. The light emitting diode lighting lamp of claim 4, wherein the light diffusion cover comprises inner grooves which are formed on both sides of an inner surface thereof along a longitudinal direction to be connected with the LED PCB.

6. The light emitting diode lighting lamp of claim 4, wherein the light diffusion cover is made of diffusing type polycarbonate or diffusing type glass.

7. The light emitting diode lighting lamp of claim 3, wherein the cover comprises:

a light diffusion cover which encloses the LED devices to diffuse light emitted from the LED devices; and a heat radiation plate which encloses a lower surface of the LED PCB to dissipate heat of the LED PCB.

8. The light emitting diode lighting lamp of claim 7, wherein the light diffusion cover and the heat radiation plate are connected to one another to form a hollow cylindrical shape.

9. The light emitting diode lighting lamp of claim 8, wherein the heat radiation plate comprises:

outer grooves which are formed on both sides of an outer surface thereof along a longitudinal direction of the hollow cylindrical shape to be connected to the light diffusion cover; and inner grooves which are formed on both sides of an inner surface thereof along a longitudinal direction of the hollow cylindrical shape to be connected to the LED PCB.

10. The light emitting diode lighting lamp of claim 8, wherein the heat radiation plate comprises:

outer grooves which are formed on both sides of an outer surface thereof along a longitudinal direction of the hollow cylindrical shape to be connected to the light diffusion cover; and a protrusion which is formed along a longitudinal direction of the hollow cylindrical shape and to which the LED PCB is mounted.

11. The light emitting diode lighting lamp of claim 10, wherein an upper surface of the protrusion is divided into two portions and a sectional view thereof is a shape of a caret symbol ˆ, and wherein the at least one LED devices are provided two and the LED devices are respectively disposed on the divided portions of the upper surface of the protrusion.

12. The light et fitting diode lighting lamp of claim 7, wherein the light diffusion cover is made of diffusing type polycarbonate or diffusing type glass.

13. The light emitting diode lighting lamp of claim 7, wherein the heat radiation plate is formed by a double injection molding with ABS(Acrylonitrile/Butadien/Styrene), PPS(Poly Phenylene Sulfide), and PPA(Poly Phthal Amide).

14. The light emitting diode lighting lamp of claim 3, wherein the LED module comprises a converter which converts an alternating current into a direct current and supplies the converted direct current to the LED PCB.

* * * * *